United States Patent [19]

Fritz

[11] Patent Number: 4,973,067

[45] Date of Patent: Nov. 27, 1990

[54] HOPPER CAR DISCHARGE GATE SEAL

[75] Inventor: William E. Fritz, Naperville, Ill.

[73] Assignee: Gen-Tech, Inc., North Aurora, Ill.

[21] Appl. No.: 408,375

[22] Filed: Sep. 18, 1989

Related U.S. Application Data

[63] Continuation-in-part of Ser. No. 208,597, Jun. 20, 1988.

[51] Int. Cl.[5] ..... B61D 7/14; B61D 7/32; B65D 53/00; F16L 19/02

[52] U.S. Cl. ..... 277/180; 220/378; 251/328; 277/209; 277/211; 277/227

[58] Field of Search ..... 277/180, 209, 211, 226, 277/207 A, 56, 27, 227, 101, 171, 199, 235 B, ; 220/81 R, 378; 105/297, 282.2, 359, 247, 282.2; 222/185; 49/498, 485; 251/328

[56] References Cited

U.S. PATENT DOCUMENTS

| | | | |
|---|---|---|---|
| 3,175,832 | 3/1965 | Carrell | 277/199 |
| 3,401,915 | 9/1968 | Kim | 251/328 |
| 3,521,892 | 7/1970 | Sheesley | 277/171 |
| 3,775,907 | 12/1973 | Weaver et al. | 49/498 |
| 3,831,803 | 8/1974 | Hutchison et al. | 220/46 R |
| 3,883,993 | 5/1975 | Pullan | 49/485 |
| 3,930,656 | 1/1976 | Jelinek | 277/180 |
| 4,109,923 | 8/1978 | Tückmantel | 277/101 |
| 4,411,941 | 10/1983 | Azzola | 49/498 |
| 4,617,220 | 10/1986 | Ginster | 49/498 |
| 4,869,945 | 9/1989 | Harney | 49/498 |

*Primary Examiner*—Allan N. Shoap
*Assistant Examiner*—Scott W. Cummings
*Attorney, Agent, or Firm*—Kinzer, Plyer, Dorn, McEachran & Jambor

[57] ABSTRACT

A peripheral sealing gasket is disclosed for use in mounting a discharge gate to the adapter frame of a railroad hopper car. The gasket has a peripheral base formed of a relatively rigid sealing material, which base is formed and adapted to be positioned between and in substantial surface contact with a discharge gate mounting flange and the hopper car adapter frame. The base has at least one sealing element on each side thereof, which sealing elements extend outwardly beyond the base and are formed of a sealing material substantially less rigid than the base. There is a recess for each sealing element whereby each sealing element will distort into its recess during use so that the base is in substantial surface contact with the mounting flange and adapter frame throughout its peripheral extent.

20 Claims, 4 Drawing Sheets

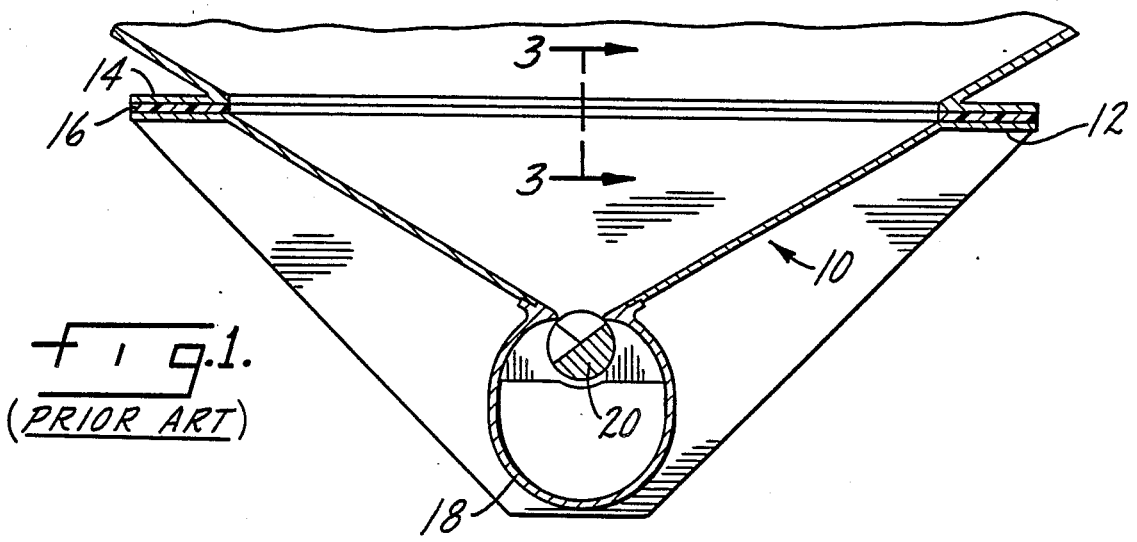
Fig. 1.
(PRIOR ART)
Fig. 3.
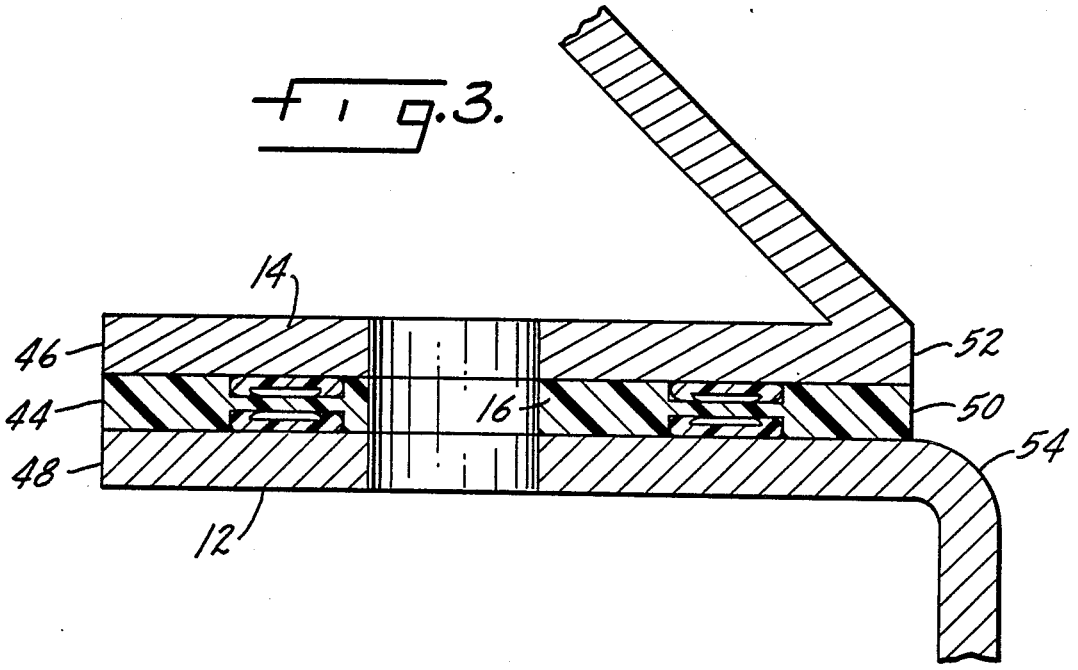
Fig. 2.
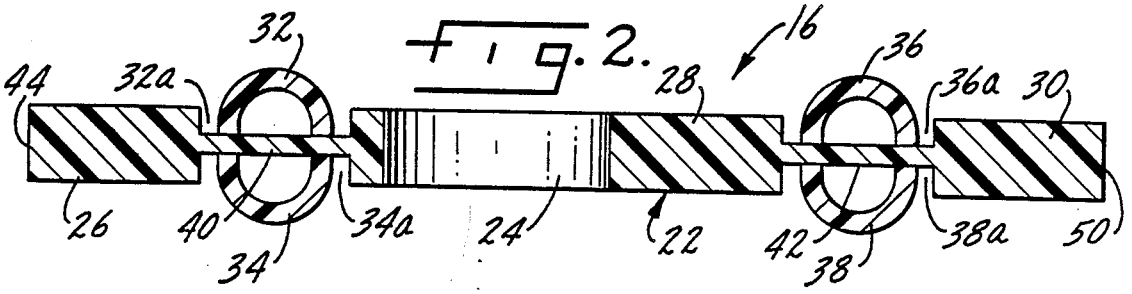

Fig. 7.
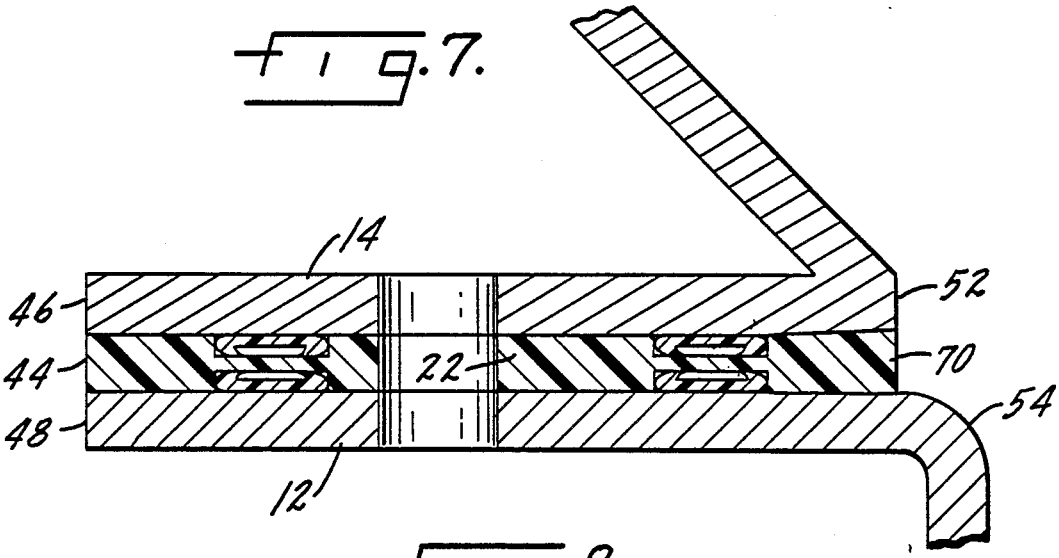
Fig. 8.
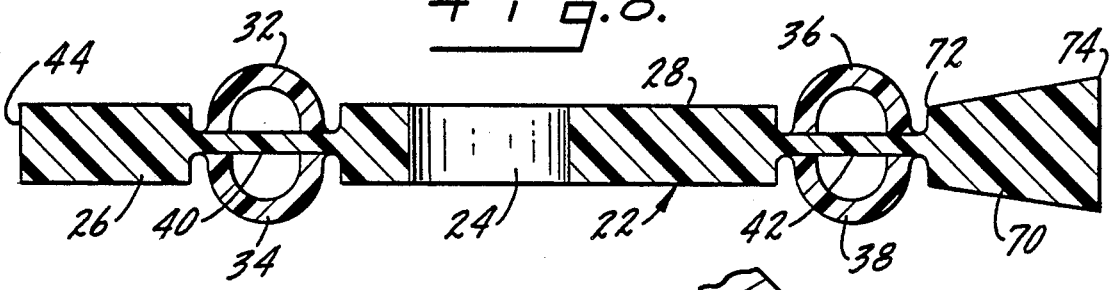
Fig. 9.
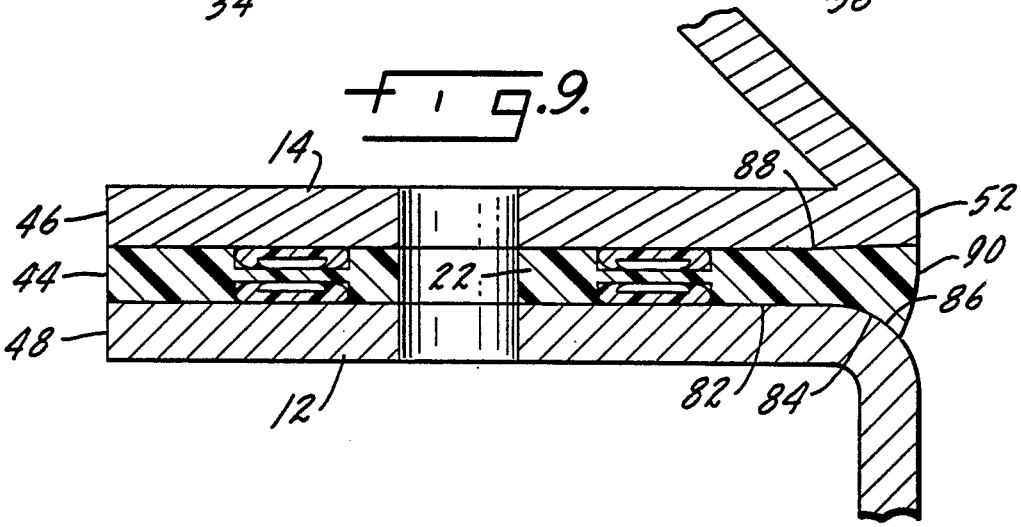
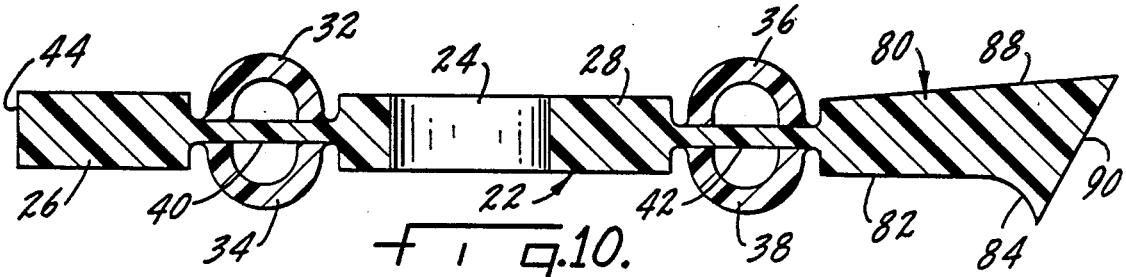
Fig. 10.

HOPPER CAR DISCHARGE GATE SEAL

SUMMARY OF THE INVENTION

This is a continuation-in-part of application Ser. No. 208,597, filed June 20, 1988.

The present invention relates to sealing gaskets for use in mounting the discharge gate to the adapter frame of a railroad hopper car.

A primary purpose of the invention is a sealing gasket for the use described which is easy to align and provides no crevices or cavities which might retain material from the hopper car load after discharge and cleaning.

Another purpose is a sealing gasket having a base formed of a relatively rigid sealing material and a plurality of outwardly-extending sealing elements, integral with the base, and extending outwardly beyond the base and formed of a sealing material substantially less rigid than the base.

Another purpose is a peripheral sealing gasket of the type described which has the same width as the adjoining surface of the hopper car adapter frame, so as to assure alignment during mounting.

Other purposes will appear in the ensuing specification, drawings and claims.

BRIEF DESCRIPTION OF THE DRAWINGS

The invention is illustrated diagrammatically in the following drawings wherein:

FIG. 1 is a section through the bottom portion of a railroad hopper car illustrating the discharge gate and the adapter frame to which it is mounted, FIG. 2 is a cross section through the sealing gasket which is the subject of the present invention, FIG. 3 is an enlarged partial section, taken on line 3—3 of FIG. 1, through a portion of the discharge gate and the adapter frame, illustrating the gasket seal as mounted, FIG. 7 is a partial section, similar to FIG. 3, showing a modified form of gasket seal in a mounted position, FIG. 8 is a cross section through the sealing gasket of FIG. 7, FIG. 9 is a partial section, similar to FIG. 7, showing a further modified form of sealing gasket, FIG. 10 is a section through the sealing gasket of the embodiment of FIG. 9.

DESCRIPTION OF THE PREFERRED EMBODIMENT

Figure 4:
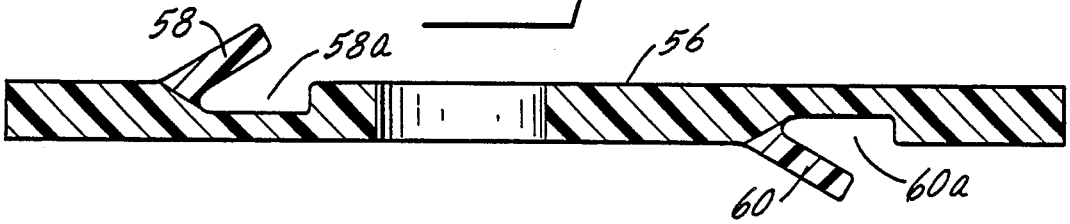
FIG. 4 is a section, similar to FIG. 2, illustrating a modified form of the invention.

The discharge chute or discharge gate of a hopper car is conventionally attached to the steel adapter frame of the hopper car using a gasket to provide an airtight seal. The conventional gaskets in use today, unless perfectly positioned and aligned between the adapter frame and the flange of the discharge gate, create small crevices between the top and/or bottom of the seal which, during the period that the car is emptied, may form a place for the material within the hopper to remain after discharge and cleaning. Since it is imperative that a hopper car be clean and free of contamination prior to loading, it has become the practice to unbolt the discharge gate from the hopper car after each unloading operation so as to insure that the car is completely free of contamination. Since there are 32 bolts holding the discharge gate to the hopper car, this is a labor intensive, and consequently expensive, operation.

One proposed solution to the problem was to place the seal within a recess in either the discharge gate or the adapter frame so that the gate and adapter frame would be in metal-to-metal contact except for the seal. Unfortunately, this solution has not been found to be acceptable. The discharge gate is conventionally formed of aluminum and the adapter frame is conventionally formed of steel, with the result that one or both of these elements would corrode, causing the seal to be imperfect. Also, since there may be a certain waviness to the metal parts, there was not always a complete metal-to-metal seal.

The present invention provides a sealing gasket which is easy to align and always forms a complete seal between the adapter frame and the flange of the discharge gate.

In FIG. 1, the discharge gate is indicated generally at 10 and has a mounting flange 12. The adapter frame has an outwardly-extending flange 14, there being a seal 16 placed between the adapter frame flange 14 and the flange 12 of the discharge gate. The discharge gate may include a discharge trough 18 having a conventional discharge valve 20 which is further described in U.S. Pat. No. 4,345,859.

FIG. 2 illustrates the seal of the present invention. It includes a peripherally-extending base 22 having mounting holes 24 spaced therein. The mounting holes are for the bolts which are used to hold flanges 12 and 14 together. The base 22 may have three separated sections: an outer section 26, a central or intermediate section 28 and an inner section 30. The inner and outer sections have generally the same width. The base preferably is formed of a sealing material, but one which is relatively rigid. For example, a material such as PVC or Santoprene having a durometer of 40D has been found to be satisfactory. In between the outer sections 26 and 30 and the intermediate section 28 there are pairs of sealing elements, arcuate or semicircular in shape, and indicated at 32, 34, 36 and 38, respectively. The elements 32–38, being hollow and semicircular in their undistorted form, extend outwardly beyond the surface of the base. They are, however, integral with webs 40 and 42 which connect the base sections together. The sealing elements 32–38 may be formed of the same type of material as the base, but of a different durometer, for example 65A, making the sealing elements substantially less rigid and more distortable than the base. In the drawings, the sealing areas of differing durometer are distinguished by different forms of cross hatching.

When the seal is assembled between the adapter frame and the flange of the discharge gate, as illustrated in FIG. 3, the outer edge 44 of seal 22 is in alignment with the outer edges 46 and 48 of the adapter frame and discharge gate mounting flanges. Thus, during installation, the mechanic can easily insure that the gasket is in proper position with the bolt holes between the elements in direct alignment.

As illustrated particularly in FIG. 2, each of the sealing elements 32–38 has associated recesses 32*a*, 34*a*, 36*a* and 38*a*. When the seal is properly assembled between the adapter frame and the discharge gate, the sealing elements 32–38 are distorted and they are distorted to the point where they generally fill the recesses 32a–38a, as shown in FIG. 3. The recesses must be of a size to completely contain the distorted seal elements when the gasket has been assembled and the bolts drawn tight. In this way, each of the sections of the base is in substantial surface contact with the abutting areas of the adapter frame and discharge gate mounting flange. It is important that the sealing elements be sufficiently distortable and the recesses be of a sufficient size so that there can be the illustrated complete surface contact between the top side of the three base sections of the gasket and the adapter frame and the bottom side of the three base sections and the top of the discharge gate mounting flange.

When the seal is correctly assembled, as illustrated in FIG. 3, not only is there alignment between the outside edges of the gasket and the adapter frame and mounting flange, but on the inside, the inner edge 50 of the sealing gasket is in alignment with the inner edge 52 of the adapter frame and the sealing gasket only rests on the flat surface of the discharge gate mounting flange. The discharge gate mounting flange has a curved inner surface 54, but the sealing gasket only sits on or is seated upon the flat portion of the mounting flange. This is important to eliminate any possible pockets which might hold the material being discharged.

FIGS. 7 and 8 illustrate a modified form of the invention specifically designed to accommodate variations in the spacing between the car frame adapter and the gate flange. Like numbers have been applied to parts of the seal which are the same as in the FIG. 2 embodiment. The principal difference between the FIGS. 2 and 8 embodiments is that in the FIG. 8 embodiment the inner base portion of the seal, illustrated at 70, gradually increases in thickness toward the inside of the seal. Base portion 70 begins at its outer edge 72 with a thickness generally the same as base portions 26 and 28. The thickness gradually increases on both sides of the seal to the outer edge 74. In this way, when the seal is positioned between the car frame adapter and the gate flange, both of which are formed of metal, tolerances and any waviness of the metal do not affect the integrity of the seal between these two elements.

The seal heretofore described is particularly adapted for new car construction in which the gate flange extends inwardly beyond the edge of the car frame adapter. In the embodiment of FIGS. 9 and 10 the seal is particularly adapted for retrofit applications in which the gate flange terminates generally coextensively with the edge of the car frame adapter. This is particularly shown in FIG. 9. In this instance, the inner base member indicated at 80 has a lower surface 82 with a curved inner edge 84 which corresponds to and mates with the curved upper surface 86 of the gate flange. The upper surface 88 of inner base member 80 may gradually increase in thickness, as in the FIG. 7 and 8 embodiment, for the same purpose. The inner surface 90 of inner base member 80 may have a slanted configuration which, when the seal is compressed as illustrated in FIG. 9, prevents the formation of pockets which could retain material after the car is emptied.

FIG. 4 illustrates a gasket with modified seal elements. A base 56 has a pair of outwardly-extending arms 58 and 60, on opposite sides of the base, with each arm having an associated recess 58a and 60a. When the seal is positioned between the mounting flanges, the arms will be bent down into the recesses so that there can be the described surface-to-surface contact between the base of the sealing gasket and the mating surfaces of the adapter frame and discharge gate flange.

Figure 5:
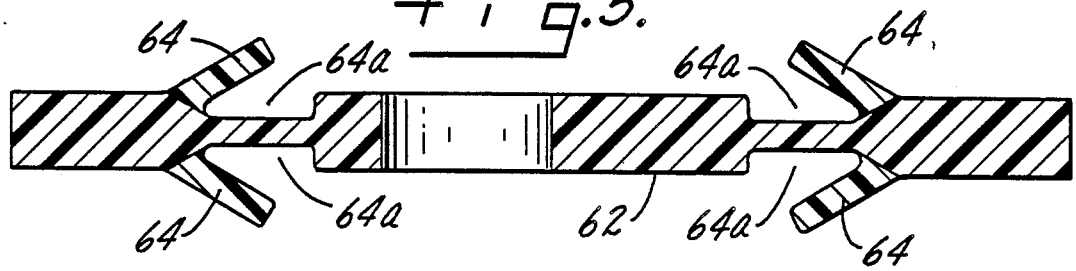
FIG. 5 is a section, similar to FIGS. 2 and 4, illustrating yet a further form of the invention.

FIG. 5 shows yet a further modified form of the invention in which the sealing gasket has a base 62 and there are arms 64 extending outwardly from the base, there being two such arms on each side of the base, with the arms facing one another. Each arm has an associated recess 64a, which is of a size and shape such that the arms will distort into the recesses when the gasket is assembled as described.

Figure 6:
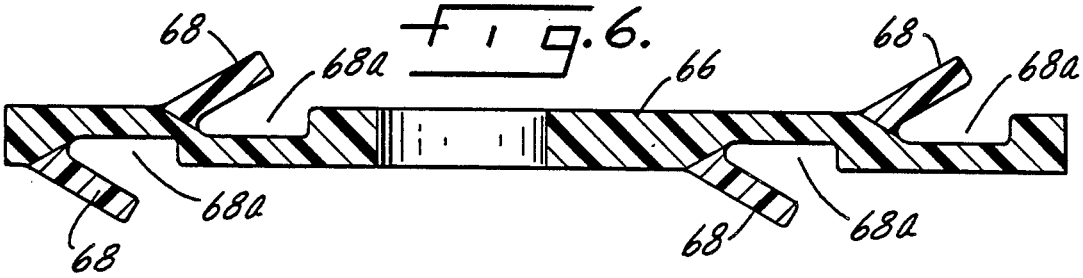
FIG. 6 is a section showing yet a further modified form of sealing gasket.

FIG. 6 shows yet a further modified form of the invention in which a base 66 again has a pair of outwardly-extending arms 68 on each side thereof. There are associated recesses 68a formed and adapted to receive the distorted arms when the gasket is assembled, as described. In this case, all of the arms are directed toward the inside edge of the gasket, rather than toward each other as in the FIG. 5 embodiment.

Figure 11:
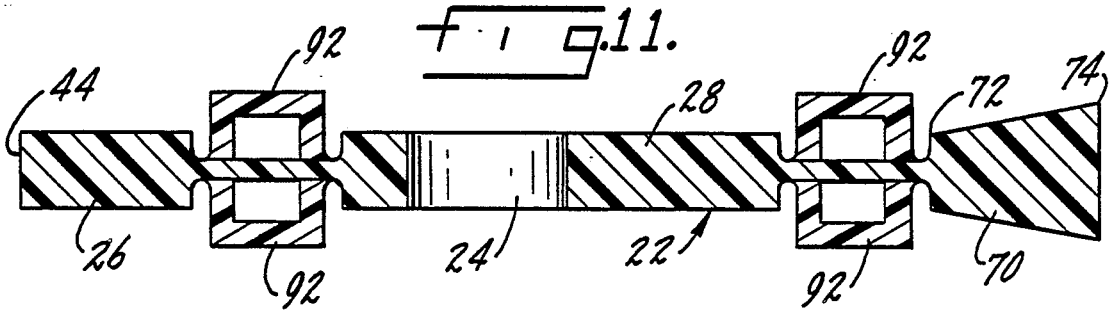
FIGS. 11, 12, 13 and 14 are sections, similar to FIGS. 2, 4, 5 and 6, each showing further modified forms of sealing gaskets.
Figure 12:
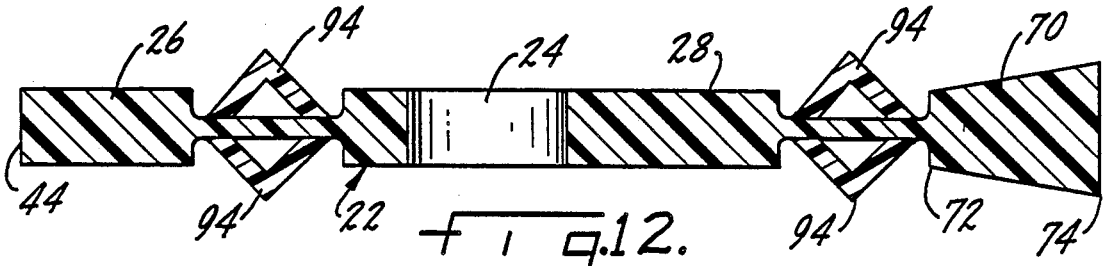
Figure 13:
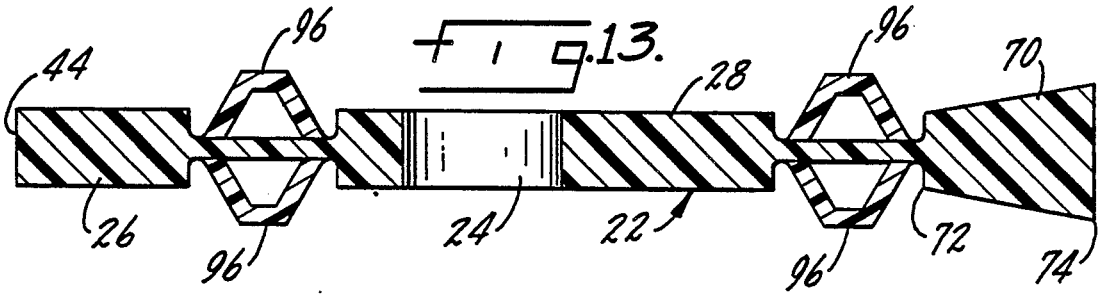

FIGS. 11, 12, 13 and 14 illustrate further modifications of the configuration of the sealing element. The body of the seal is the same as shown in FIG. 8. In each case there is a base, a pair of sealing elements on each side of the base, and a recess formed and adapted to contain the sealing elements when they are distorted under load. The embodiments of FIGS. 11, 12 and 13 are designed to illustrate alternate configurations of a sealing element which essentially is a hollow extension. In the FIG. 11 embodiment the hollow extensions 92 have a somewhat rectangular exterior, whereas, in the embodiment of FIG. 12 the hollow extensions 94 have a triangular exterior. In the FIG. 13 embodiment the hollow extensions 96 have a trapezoidal exterior. In each case, when the extensions are under load, they will be distorted into the area of the recess associated with the extension.

Figure 14:
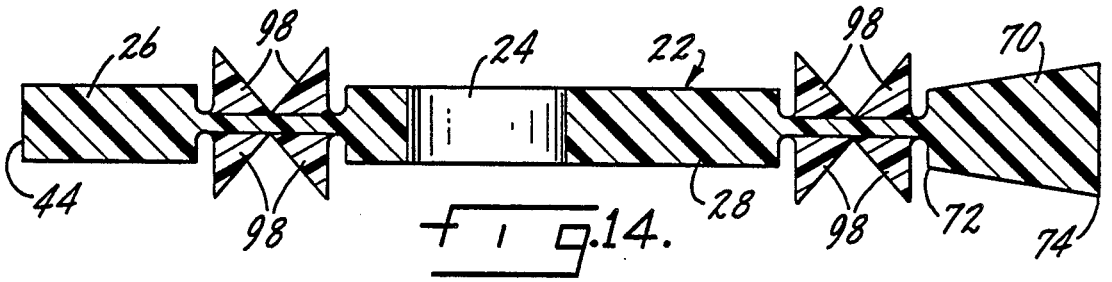

In the FIG. 14 embodiment, the sealing element may consist of a pair of triangular-shaped projections 98. The projections diverge, although projections which are more in the shape of an equilateral triangle may be equally satisfactory. What is important is to provide projections, which in this case are solid, which extend beyond the boundary of the base and which, under load, will distort into the accompanying recess.

Of importance in the invention is the use of a gasket which has portions thereof formed of different durometer sealing material. The base is relatively rigid and is designed for surface-to-surface contact with the adjacent metal surfaces. The outwardly-extending sealing elements are more flexible and more easily distorted than the base and have associated recesses into which the sealing elements are distorted when the gasket is properly assembled. Both the base and sealing elements may be of the same type of material, but yet of different durometer. Or they could be of different types of material. The sealing elements are integral with the webs, which in turn are integral with the sections of the base so that the gasket is a single, peripheral unit. It is important that the recesses associated with the outwardly-extending sealing elements be of a size to receive the distorted sealing elements so that there can be substantial and complete surface contact between the gasket base and the mating metal surfaces of the adapter frame and the discharge gate mounting flange.

Whereas the preferred form of the invention has been shown and described herein, it should be realized that there are many modifications, substitutions and alterations thereto.

The embodiments of the invention in which an exclusive property or privilege is claimed are defined as follows:

1. A peripheral elastic sealing gasket for use in mounting a discharge gate to the adapter frame of a railroad hopper car, said gasket having a peripheral base formed of a relatively rigid elastic sealing material and adapted to be positioned between and in substantial surface contact with a discharge gate mounting flange and a hopper car adapter frame, at least one sealing element on each side of said base and integral therewith, extending outwardly beyond the base, and being formed of an elastic sealing material substantially less rigid than said base, a recess for each sealing element whereby each sealing element will distort into its associated recess during use so that said base can be in substantial surface contact with said mounting flange and adapter frame.

2. The sealing gasket of claim 1 further characterized in that each sealing element is arcuate in cross section.

3. The sealing gasket of claim 2 further characterized in that said sealing elements are aligned on opposite sides of said base.

4. The sealing gasket of claim 1 including a pair of spaced sealing elements on each side of said base.

5. The sealing gasket of claim 4 further characterized in that said sealing elements on each side of said base are in alignment and spaced equal distances from edges of said sealing gasket.

6. The sealing gasket of claim 1 further characterized in that each sealing element is in the form of an outwardly-extending arm.

7. The sealing gasket of claim 6 further characterized in that the sealing element arms, on each side of said base, extend in the same direction.

8. The sealing gasket of claim 6 further characterized by a pair of sealing elements on each side of said base, each of said sealing elements being in the form of an outwardly-extending arm.

9. The sealing gasket of claim 8 further characterized in that said outwardly-extending arms, on each side of said base, extend in the same direction.

10. The sealing gasket of claim 8 further characterized in that the sealing element arms, on each side of said base, extend toward one another.

11. The sealing gasket of claim 1 further characterized in that said peripheral base has width equal to the mounting surface of the adapter frame.

12. The sealing gasket of claim 1 further characterized in that each sealing element is in the form of a hollow extension.

13. The sealing gasket of claim 12 further characterized in that said hollow extension has a curved outer surface.

14. The sealing gasket of claim 12 further characterized in that said hollow extension has a triangular outer surface.

15. The sealing gasket of claim 12 further characterized in that said hollow extension has a generally trapezoidal outer surface.

16. The sealing gasket of claim 12 further characterized in that said hollow extension has a generally rectangular outer surface.

17. The sealing gasket of claim 1 further characterized in that each sealing element includes a pair of spaced outwardly-extending solid projections.

18. The sealing gasket of claim 1 further characterized in that said peripheral base has an exterior peripheral portion and an interior peripheral portion, the interior peripheral portion having, at least in part, a thickness greater than that of the exterior peripheral portion.

19. The sealing gasket of claim 18 further characterized in that said base interior peripheral portion gradually increases in thickness toward the inside of said peripheral base.

20. The sealing gasket of claim 1 further characterized in that said peripheral base has a width generally equal to the mounting surface of the adapter frame, with that portion of the sealing gasket in contact with the mounting flange having a curved surface corresponding to the inner curved surface of the mounting flange.

* * * * *